US008055182B2

(12) United States Patent
Koyanagi

(10) Patent No.: US 8,055,182 B2
(45) Date of Patent: Nov. 8, 2011

(54) IMAGE FORMING APPARATUS

(75) Inventor: Noriaki Koyanagi, Toride (JP)

(73) Assignee: Canon Kabushiki Kaisha (JP)

( * ) Notice: Subject to any disclaimer, the term of this patent is extended or adjusted under 35 U.S.C. 154(b) by 597 days.

(21) Appl. No.: 12/199,373

(22) Filed: Aug. 27, 2008

(65) Prior Publication Data

US 2009/0060616 A1 Mar. 5, 2009

(30) Foreign Application Priority Data

Sep. 3, 2007 (JP) ..... 2007-228150

(51) Int. Cl.
*G03G 15/00* (2006.01)

(52) U.S. Cl. ..... 399/401; 399/397

(58) Field of Classification Search ..... 399/401
See application file for complete search history.

(56) References Cited

U.S. PATENT DOCUMENTS 4,085,673 A * 4/1978 Wierszewski ..... 101/242
4,110,025 A * 8/1978 Tabata ..... 399/401
4,176,945 A * 12/1979 Holzhauser et al. ..... 355/23
4,573,789 A * 3/1986 Wada ..... 399/364
4,693,586 A * 9/1987 Sumida et al. ..... 399/401
4,928,128 A * 5/1990 Stemmle ..... 399/364
7,703,768 B2 * 4/2010 Tamura et al. ..... 271/264
7,823,878 B2 * 11/2010 Su et al. ..... 271/186
2003/0020228 A1 * 1/2003 Kobayashi et al. ..... 271/3.14
2006/0140694 A1 * 6/2006 Yano ..... 399/393
2007/0041764 A1 * 2/2007 Pareigis et al. ..... 399/401

FOREIGN PATENT DOCUMENTS

JP 2002-20000 A 1/2002
JP 2003-122061 A 4/2003

* cited by examiner

*Primary Examiner* — Anthony Nguyen
(74) *Attorney, Agent, or Firm* — Rossi, Kimms & McDowell LLP

(57) ABSTRACT

A reverse conveying apparatus which again conveys a sheet formed an image by an image forming portion to the image forming portion includes a plurality of roller grippers which supports a sheet formed an image, and a belt which moves the roller grippers to a receiving position where a sheet is received and a carry-out position where a supported sheet is conveyed out. When a sheet is conveyed out in the carry-out position, the sheet is conveyed out such that a rear end thereof when it is received at the receiving position is a leading end.

8 Claims, 19 Drawing Sheets

IMAGE FORMING APPARATUS

BACKGROUND OF THE INVENTION

1. Field of the Invention

The present invention relates to an image forming apparatus, and more particularly, to an image forming apparatus which again conveys a sheet on which an image is formed to an image forming portion.

2. Description of the Related Art

In an image forming apparatus, sheets of various materials are fed to an image forming portion by a sheet conveying apparatus, and an image is formed on the sheet in the image forming portion and the sheet is discharged.

In the image forming apparatuses of recent years, to enhance the productivity, speed-up tendency and capacity-increasing tendency of image forming processing are accelerating, and a conveying speed of sheets also increasing. With the speed-up tendency of the sheet conveying operation, the conveying stability of sheet is more required.

Some image forming apparatuses again convey a sheet on which an image is formed to the image forming portion by a re-conveying portion, and forms a new image on the previously formed image. Some image forming apparatuses have a mode for forming images on front and back surfaces of a sheet (both-surface image forming mode, hereinafter). This technique is described in Japanese Patent Application Laid-open No. 2003-122061).

When images are formed on both surfaces of a sheet, the sheet is reversed at the re-conveying portion provided in the image forming apparatus, and images are formed on front and back surfaces of the sheet.

Conventionally, a sheet reverse portion which is one example of the re-conveying portion employs a switch back system. FIG. 19 shows a structure of the sheet reverse portion of the switch back system. When a sheet is to be reversed, a sheet S fed from the sheet feeding portion 112 passes through a vertically conveying path 120 and is conveyed downstream. The vertically conveying path 120 is provided at its downstream side with a registration roller apparatus 130. The registration roller apparatus 130 corrects final screw feeding of a sheet, synchronizes between an image writing operation in an image forming portion 140 and a sheet conveying operation.

The image forming portion 140 is provided at its downstream side with a fixing device 150. When a sheet passes through the fixing device 150, a toner image is fixed to a first surface of the sheet as a permanent image. When an image is to be formed on a second surface which is a back surface of the sheet, the sheet is conveyed to a sheet reverse portion 170 which also serves as an entrance to the duplex conveying path 180 by switching a conveying path switching means (not shown) provided downstream from the fixing device 150.

Next, the sheet is switched back by the sheet reverse portion 170, the sheet is conveyed to the duplex path 180. The sheet S which is reversed by such a conveying operation is conveyed to the image forming portion 140 through the vertically path 120, and an image is formed on the second surface of the sheet. After the image is formed on the second surface in this manner, the sheet S is conveyed to the fixing device 150, the second surface on which the images is fixed by the fixing device 150 is discharged out from a printer body 200 through the discharge path 160, and the sheet S is received by a discharge tray 161.

In the case of such a switch back system, if a large amount of sheets are conveyed at high speed, the probability that a paper jam occurs is increased. A location where a jam is prone to occur is an entrance portion of a sheet conveying path such as the arc vertically conveying path 120, and a junction constituting a sheet conveying path, and timing at which a jam is prone to occur is when a sheet moves toward a roller nip.

When a sheet is conveyed at high speed, especially when the sheet passes through an arc path, a sliding resistance between the sheet and a conveying guide is increased. If the sliding resistance is increased, a sheet may be folded, the sheet is charged with static electricity and the sheet is attracted, the sheet may slide on a guide plate, and a surface of the sheet on which an image is formed may be damaged.

When a sheet is conveyed at higher speed, if the sheet irrupts into the roller nip portion, when the sheet is soft and thin, the sheet does not easily enter the roller nip portion, and when the sheet is not nipped by the roller, the behavior of a tip end of the sheet becomes unstable due to an air resistance and a resistance of a guide plate.

In the case of the switch back system, in a reverse portion 170, the switch back of a sheet is carried out between other two sheets. Therefore, it is necessary to normally and reversely rotate the roller at high speed, sheets which are switched back in the path slide on each other, and the probability that a jam occurs due to slip of the roller is high.

That is, in the conventional image forming apparatus, a plurality of arc path portions exist and sheets are delivered at the duplex conveying portion and the reverse portion, and a jam is prone to occur at these portions. If the number of these portions is increased, the probability that a jam occurs is increased.

The duplex conveying portion and the reverse portion are constituted such that the conveying path is surrounded by a guide plate. Therefore, a sheet and the guide plate which receives high heat in the fixing device carry the heat to both-surface portion, and this increases the temperature in the apparatus, heat is accumulated in these portions, and this increases the temperature in the apparatus. If the temperature in the apparatus rises, the temperature of the image forming portion is increased by the sheet in the both-surface image formation, and appropriate images can not be formed.

To solve the problem caused when a sheet is conveyed by such a conventional switch back system, there is a technique in which a sheet is reversed by conveying the sheet while twisting the sheet using two belts. This technique is described in Japanese Patent Application Laid-open No. 2002-020000.

In the case of this structure, since a sheet is not delivered or the arc path portion does not exist unlike the roller conveyance, it is possible to prevent a jam from being generated. Since a guide plate which surrounds the conveying path does not exist, it is possible to prevent a temperature in the apparatus from rising.

In the case of the conventional image forming apparatus in which a sheet is again conveyed while twisting the sheet, the conveyance distance of a sheet is increased in order to twist the sheet and reliably turn the sheet over. As a result, the image forming apparatus is increased in size.

Further, if a sheet is turned over while moving the sheet at high speed, since the sheet is deviated in the twisting direction in some cases, the turning over and conveying speed of a sheet is limited. That is, when a sheet is conveyed while twisting the same, there is a problem that the image forming apparatus is increased in size and it is not possible to increase the conveying speed of a sheet.

SUMMARY OF THE INVENTION

The present invention provides an image forming apparatus capable of conveying a sheet at high speed without increasing the apparatus in size.

The invention provides an image forming apparatus comprising an image forming portion and a re-conveying portion which again conveys a sheet formed an image by the image forming portion to the image forming portion, wherein the re-conveying portion includes a plurality of sheet support portions which support a sheet formed an image by the image forming portion, and a moving member which moves the plurality of sheet support portions to a receiving position where a sheet is received and a carry-out position where a supported sheet is conveyed out, wherein a sheet is conveyed out at the carry-out position, the sheet is conveyed out such that a rear end of the sheet at the receiving position is a leading end at the carry-out position.

Further features of the present invention will become apparent from the following description of exemplary embodiments (with reference to the attached drawings)

DESCRIPTION OF THE EMBODIMENTS

The best mode for carrying out the present invention will be explained in detail with reference to the drawings.

Figure 1:
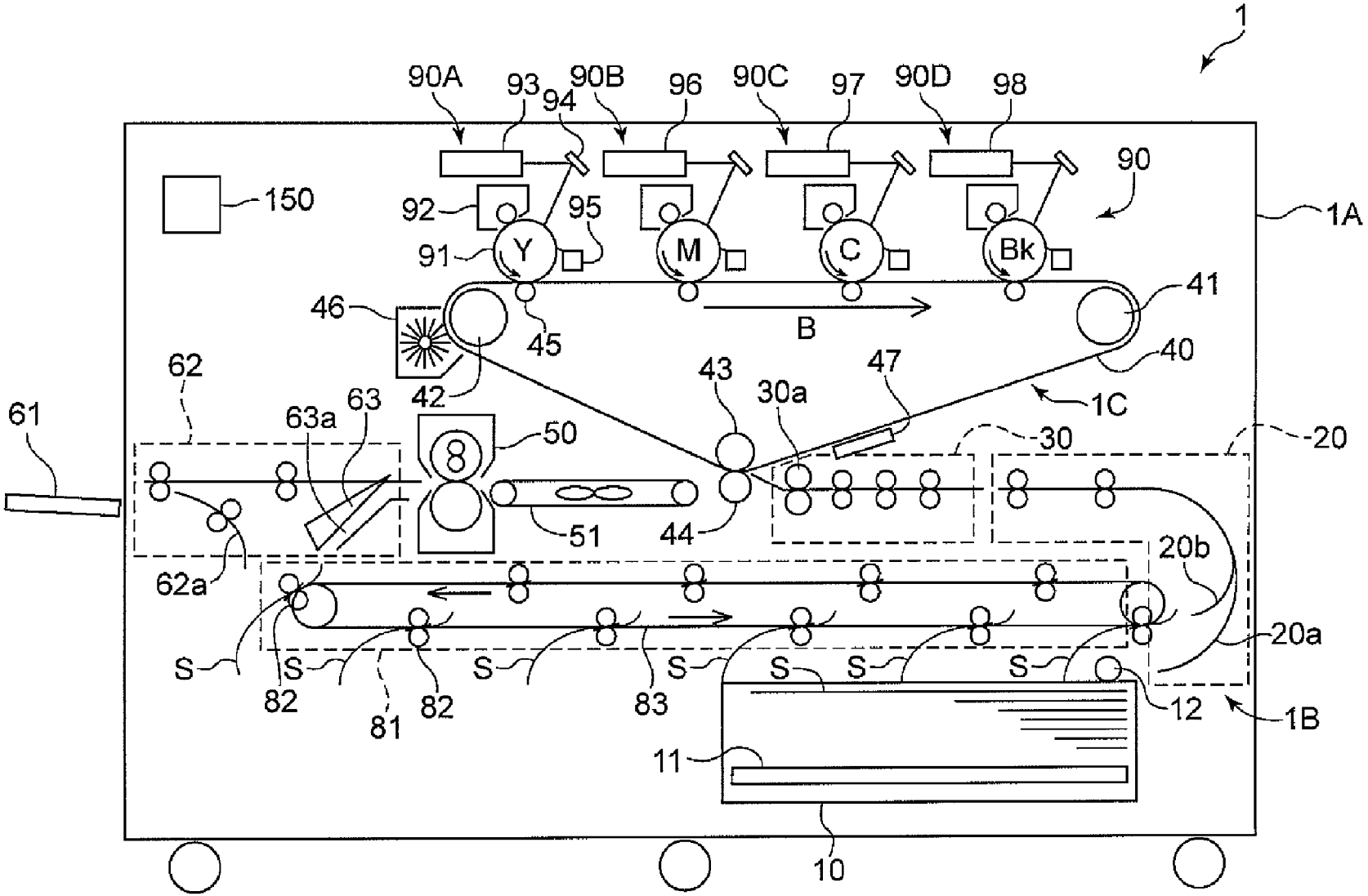
FIG. 1 is a diagram illustrating an outline structure of a color image forming apparatus which is one example of an image forming apparatus according to a first embodiment of the present invention.

FIG. 1 is a diagram showing an outline structure of a color image forming apparatus which is one example of an image forming apparatus according to a first embodiment of the invention.

FIG. 1 shows a color image forming apparatus 1 and a color image forming apparatus 1A (apparatus body, hereinafter). The apparatus body 1A includes an image forming portion 90, a sheet conveying apparatus 1B which conveys sheets S, and a transfer portion 1C which transfers a toner image formed by the image forming portion 90 onto a sheet S conveyed by the sheet conveying apparatus 1B.

The image forming portion 90 has image forming units 90A to 90D of yellow (Y), magenta (M), cyan (C) and black (Bk). Each of the image forming units 90A to 90D includes a developing device 92, an exposure apparatus 93, a developing device 92, a primary transfer roller 45, a photosensitive cleaner 95 and a charger (not shown). Colors formed by the image forming units 90A to 90D are not limited to these four colors, and the order of the colors is not limited.

The sheet conveying apparatus 1B includes a sheet storage case 10 which can be pulled out from the apparatus body 1A by a slide rail (not shown), and a sheet feeding roller 12 which sends out sheets S stored in the sheet storage case 10. The sheet storage case 10 includes a sheet feeding lifter plate 11 which presses the stacked sheets S against the sheet feeding roller 12. As the sheet conveying apparatus 1B, a structure which picks up the top sheet by the sheet feeding roller 12 and sends out downstream is employed, but an air feeding structure which sucks a sheet by air and sends the same can also be employed.

The transfer portion 1C includes an intermediate transfer belt 40. The intermediate transfer belt 40 is stretched by rollers such as a drive roller 42, a tension roller 41 and a secondary transfer inner roller 43, and is conveyed and driven in the direction of the arrow B in the drawing.

The intermediate transfer belt 40 transfers a toner image formed on the photosensitive drum by a predetermined pressure or electrostatic load bias given by the primary transfer roller 45. A non-fixed image is sucked onto a sheet in a secondary transfer portion formed by the opposed secondary transfer inner roller 43 and secondary transfer outer roller 44 by giving a predetermined pressure or electrostatic load bias.

In FIG. 1, a control portion 150 controls the image forming operation and the sheet feeding operation of the color image forming apparatus 1.

In the color image forming apparatus 1 having such a structure, when an image is formed, a surface of the photosensitive drum 91 is previously uniformly charged by the charger. Then, the exposure apparatus 93 emits light to the photosensitive drum 91 which rotates in the direction of the arrow based on a signal of the sent image information, the surface of the photosensitive drum 91 is irradiated with this light through reflection means 94, and a latent image is formed. Transfer toner which slightly remains on the photosensitive drum 91 is collected by the photosensitive cleaner 95 and the toner will be used for next image formation.

Next, a latent image formed on the photosensitive drum 91 in this manner is toner-developed by the developing device 92, and a toner image is formed on the photosensitive drum 91. Then, predetermined pressure and electrostatic load bias are given by the primary transfer roller 45, thereby transferring the toner image on the photosensitive drum onto the intermediate transfer belt 40.

Images are formed by the image forming units 90A to 90D of Y, M, C and Bk of the image forming portions with timing when upstream toner image which is primary transferred is superposed on the intermediate transfer belt. As a result, a full color toner image is finally formed on the intermediate transfer belt 40.

A sheet S is sent out from the sheet storage case 10 by the sheet feeding roller 12 with image forming timing of the image forming portion 90. Then, the sheet S is conveyed to a registration unit 30 through a vertically conveying path 20*a* of the sheet conveying apparatus 20.

In the registration unit 30, screw feeding and timing are corrected by a registration roller 30*a* and then, the sheet is conveyed to a secondary transfer portion formed of the opposed secondary transfer inner roller 43 and secondary transfer outer roller 44. Then, a predetermined pressure and electrostatic load bias are given in the secondary transfer portion, and a full color toner image is secondary transferred onto the sheet S.

Next, the sheet S on which the toner image is secondary transferred is conveyed to the fixing device 50 by a pre-fixing conveying portion 51. In the fixing device 50, the toner is melted and fixed onto the sheet S by applying a predetermined pressure by the substantially opposed rollers or belts and by heating using a heat source such as a peak.

Next, the sheet S having the fixed image obtained in this manner is discharged to a discharge tray 61 as it is by a branch conveying apparatus 62. When images are to be formed on both surface of the surface, the sheet S is then conveyed to a reverse conveying apparatus 81 constituting a re-conveying portion by the branch conveying apparatus 62 by switching of a switchable conveying path switching means (switching means, hereinafter) 63.

If the sheet is conveyed to the reverse conveying apparatus 81 in this manner, the sheet S merges from a re-feeding path 20*b* of the sheet conveying apparatus 20 with timing of a subsequent sheet which is conveyed from the sheet conveying apparatus 1B. The, the sheet is sent to the secondary transfer portion. Since the image forming process is the same as that of the first surface, the explanation of the process will be omitted.

The reverse conveying apparatus 81 includes a endless belt 83 which is a moving member provided between a carry-in port 63*a* into which a sheet carrying on its first surface an image is carried and a re-feeding path 20*b* from which the sheet is conveyed out toward the vertically conveying path 20*a*. The reverse conveying apparatus 81 includes a plurality of roller grippers 82 which are sheet support portions. The roller grippers 82 are pivotally supported by the belt 83 and receive and support a sheet from the carry-in port 63*a*.

When images are to be formed on both surfaces, the sheet S is delivered to one of the roller grippers 82 which waits below the switching means 63 by the switching operation of the switching means 63. Then, the sheet S on both surfaces of which images are to be formed and which is supported by the roller gripper 82 is conveyed toward the vertically conveying path from the discharging side by moving the endless belt 83.

Next, when the roller gripper 82 reaches a predetermined discharging position on the side of the vertically conveying path, the sheet S is conveyed out toward the re-feeding path 20*b*. Then, the sheet S reaches the vertically conveying path 20*a* through the re-feeding path 20*b*, and is conveyed to the secondary transfer portion through the vertically conveying path 20*a* in a state where its back surface is directed upward.

A toner image is transferred to the back surface of the sheet S in the secondary transfer portion, and the toner image is fixed thereafter. After the toner image is fixed in this manner, the sheet S is discharged outside of the printer body 1 by the branch conveying apparatus 62, and stacked on the discharge tray 61.

Next, a structure of the roller gripper 82 will be explained.

Figure 2:
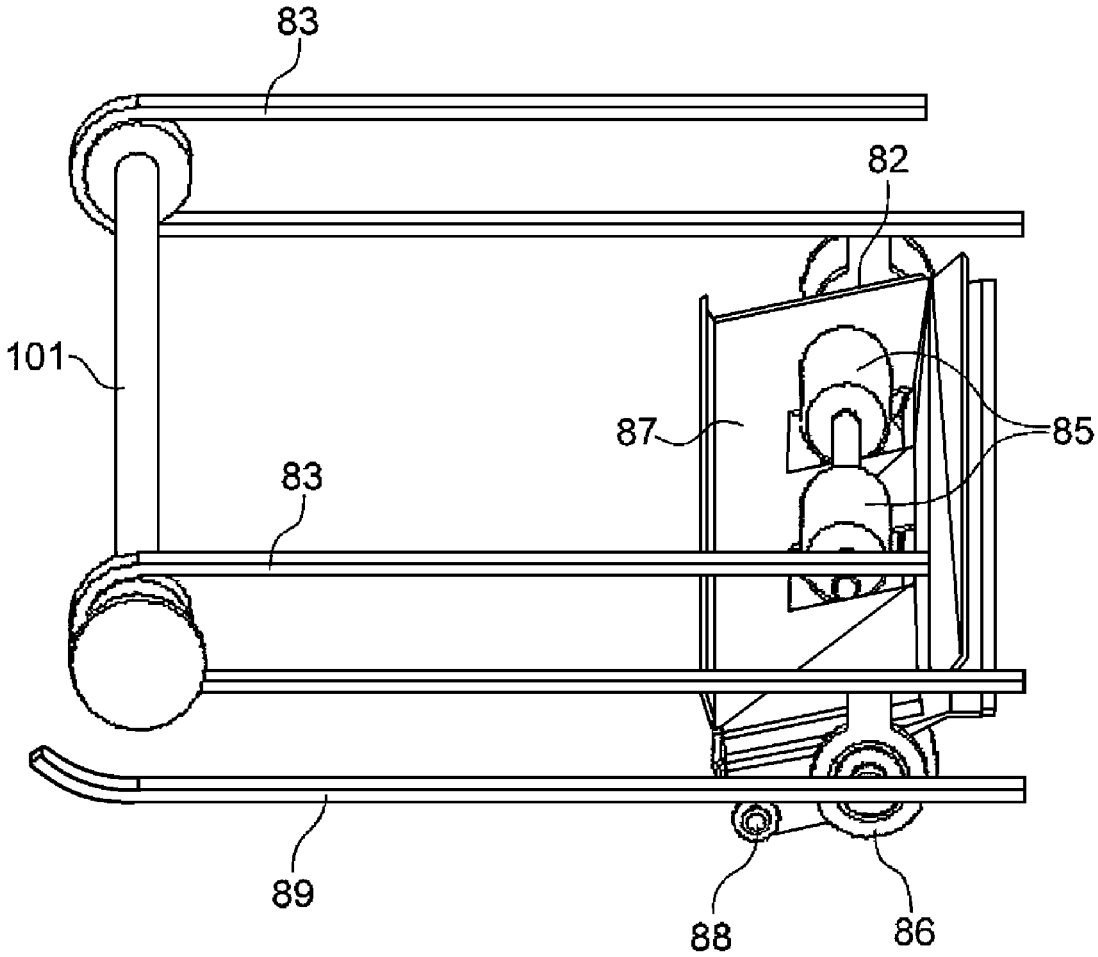
FIG. 2 is a first diagram for explaining a structure of a roller gripper provided in a reverse conveying apparatus of the color image forming apparatus.
Figure 3:
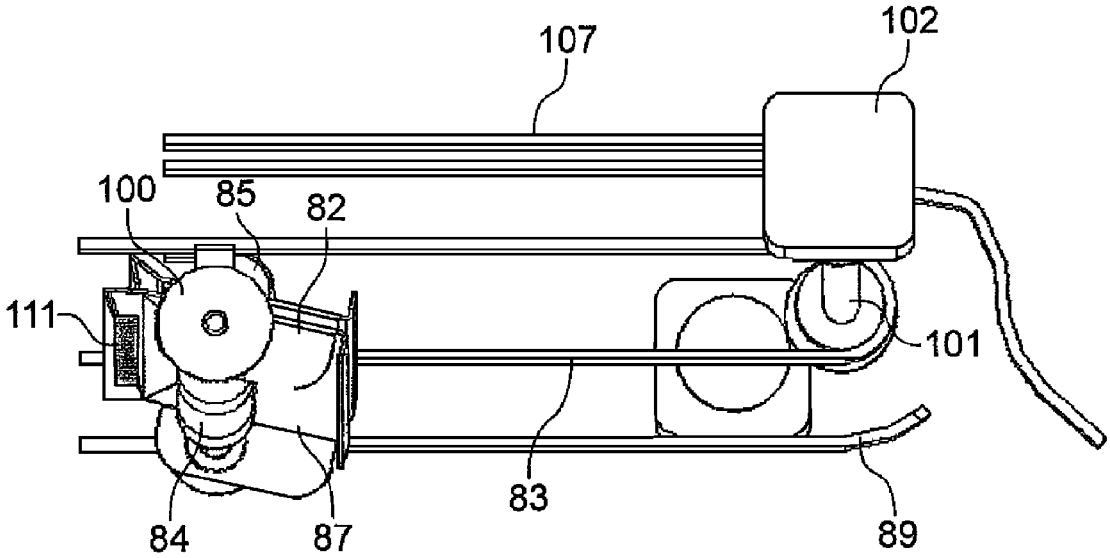
FIG. 3 is a second diagram for explaining a structure of a roller gripper provided in the reverse conveying apparatus of the color image forming apparatus.

As shown in FIGS. 2 and 3, the roller gripper 82 includes a pair of conveying rollers 84 and 85 comprising normally and reversely rotatable drive roller 84 and follower roller 85, and a guide member 87 which receives a sheet from the carry-in port and guides the sheet to nip portions of the pair of conveying rollers 84 and 85.

The roller gripper 82 receives a sheet from the carry-in port when the drive roller 84 normally rotates, and supports (holds) the sheet by the pair of conveying rollers 84 and 85 when the drive roller 84 stops. When the drive roller 84 reversely rotates, a sheet is conveyed out toward the re-feeding path 20*b*.

Figure 4:
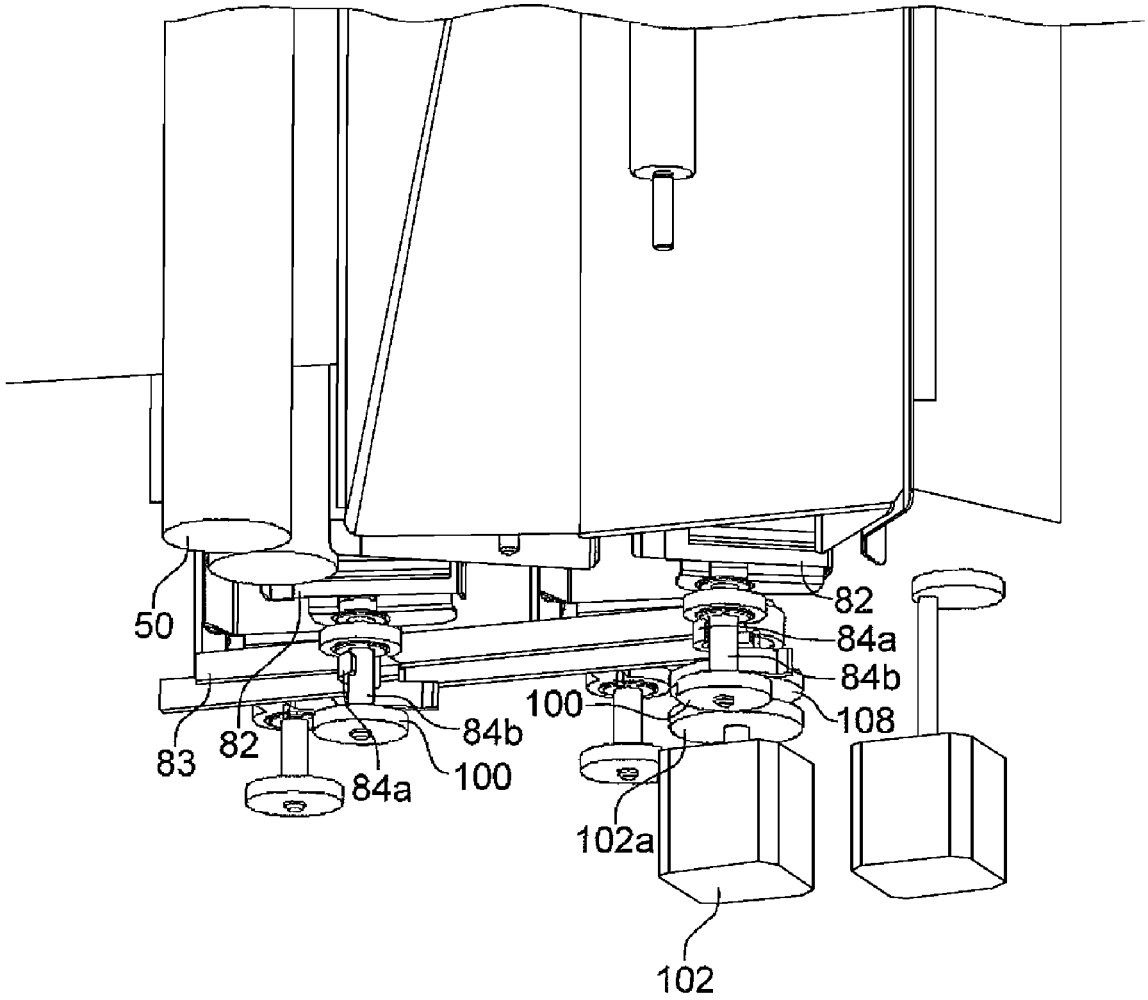
FIG. 4 is a first diagram for explaining a structure of the reverse conveying apparatus of the color image forming apparatus.
Figure 5A:
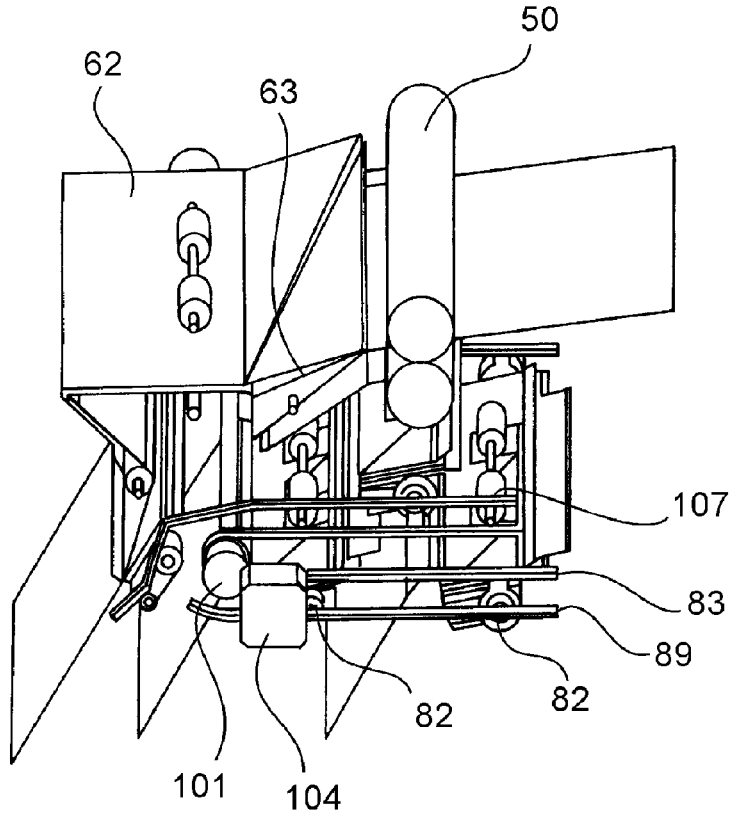
FIG. 5 are diagrams for explaining a state when a sheet of the reverse conveying apparatus is received.
Figure 5B:
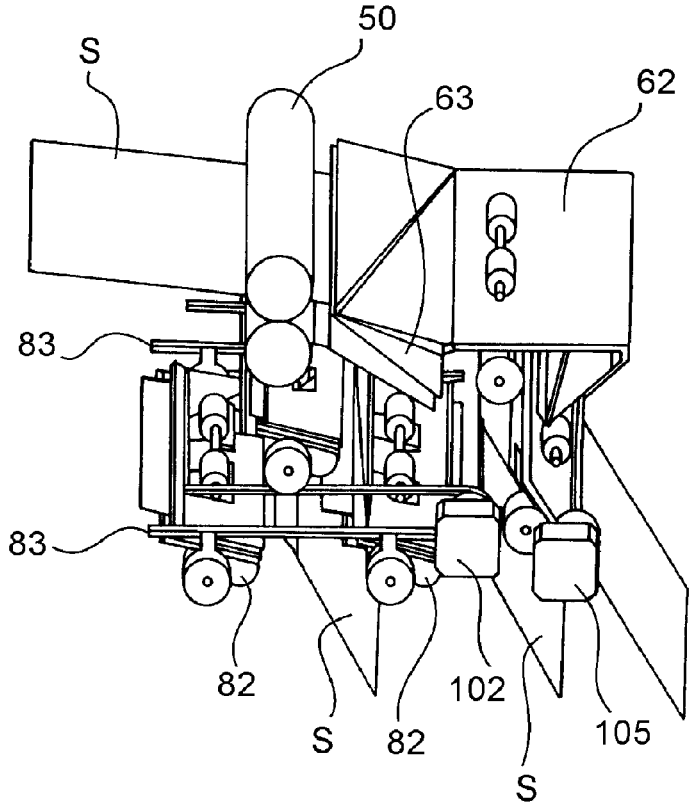

As shown in FIGS. 4 and 5, when the roller gripper 82 reaches a receiving position, the drive roller 84 is driven by meshing between a gear 100 fixed to a roller shaft 84*b* of the drive roller 84 and a drive gear 102*a* of a roller drive motor 102 which is a first drive portion.

Figure 6A:
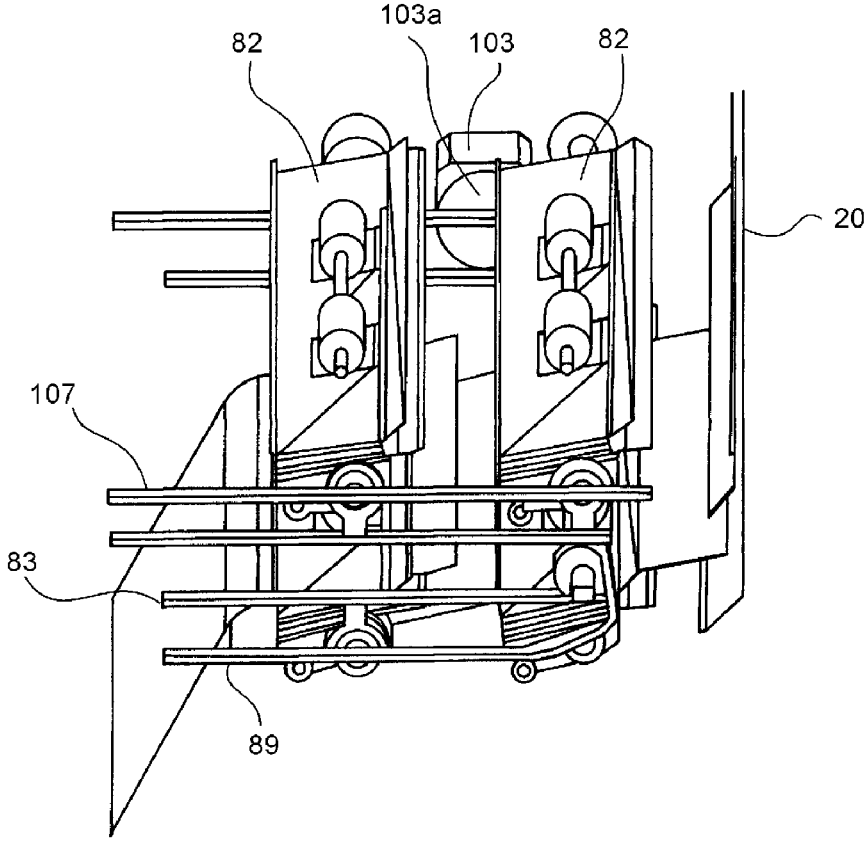
FIG. 6 are diagrams for explaining a state when a sheet of the reverse conveying apparatus is sent out.
Figure 6B:
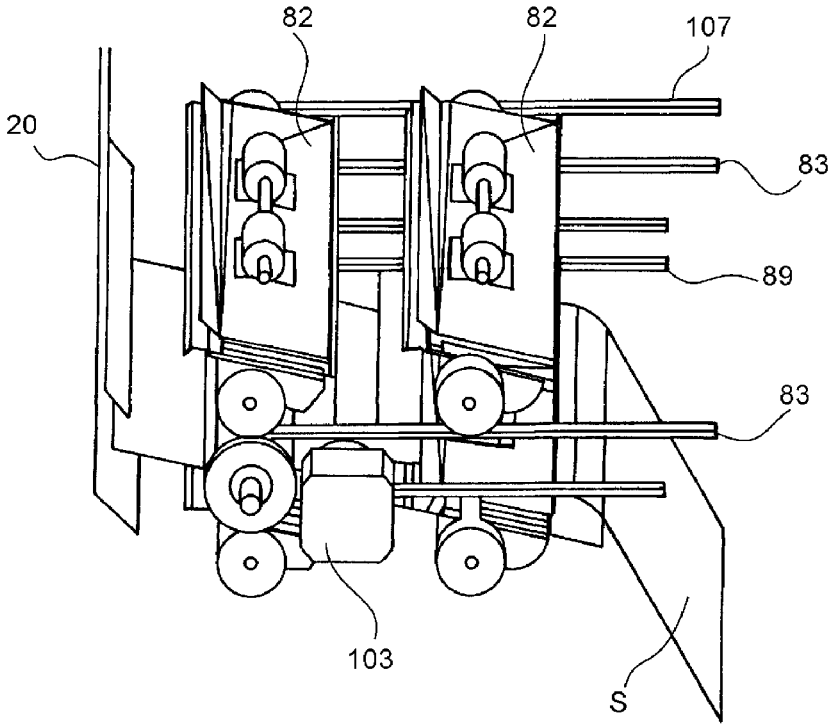

As shown in FIG. 6, when the roller gripper 82 reaches a carry-out position, it is driven by meshing between the gear 100 fixed to the roller shaft 84*b* of the drive roller 84 and a drive gear 103*a* of a roller drive motor 103 which is a second drive portion.

The roller shaft 84*b* of the drive roller 84 is locked by a lock member 84*a* shown in FIG. 4 provided on the roller gripper 82 except when the drive roller 84 is driven by the roller drive motors 102 and 103. Since the drive roller 84 is locked by the lock member 84*a*, the drive roller 84 does not rotate while a sheet is supported by the pair of conveying rollers 84 and 85. Therefore, it is possible to support a sheet. The lock member 84*a* is pushed against the roller shaft 84*b* of the drive roller 84 by a spring (not shown), thereby applying a load to the roller shaft 84*b*.

As shown in FIG. 4, when the roller gripper 82 reaches a receiving position where a sheet is received, the lock member 84*a* moves in a direction opposite from the biasing direction by a rotatable spacer 108 which constitutes an unlocking portion. With this, the lock member 84*a* is unlocked, the drive roller 84 is brought into a rotatable state, and a subsequent sheet can be received.

The spacer 108 is also provided on the side of the re-feeding path. When the roller gripper 82 reaches the carry-out position, the lock member 84*a* is unlocked by the spacer 108, the drive roller 84 is brought into the rotatable state, and a subsequent sheet can be conveyed out.

The roller grippers 82 are rotatably supported by pivotally supporting members 86 fixed to belts 83 shown in FIG. 2. Each roller gripper 82 includes a retaining member 88 which is retained to posture guide members 89 and 107 from below.

As shown in FIG. 3, a weight 111 is provided on a tip end of the roller gripper 82 in its moving direction. When the posture guide members 89 and 107 do not exist, i.e., when the retaining member 88 is not retained to the posture guide members 89 and 107, the guide member 87 can be held substantially horizontally by the weight 111 around the pivotally supporting member 86. Although the weight is employed to keep balance in this embodiment, a spring may be employed to keep balance.

Next, the turnover conveyance operation of the reverse conveying apparatus 81 having the roller gripper 82 of such a structure in which a first surface of the sheet on which an image is formed is turned over and the sheet is conveyed to the image forming portion will be explained.

Figure 7A:
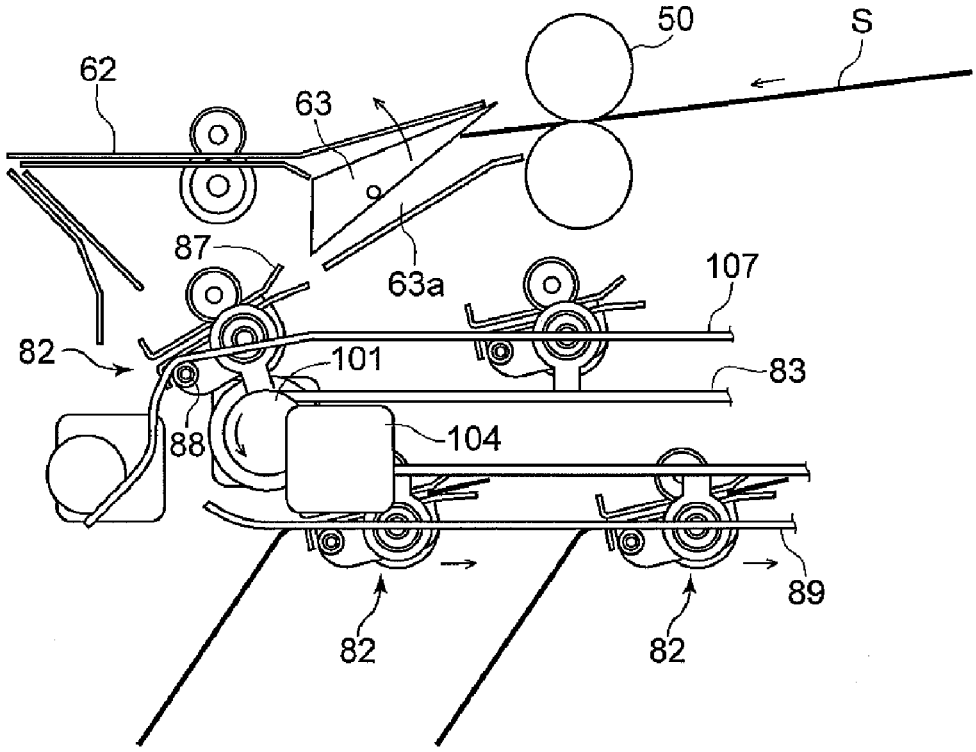
FIG. 7 are first diagrams for explaining a sheet turnover conveying operation of the reverse conveying apparatus.

When images are to be formed on both surfaces, a sheet S is introduced toward the roller gripper 82 by switching the switching means 63. Up to this time point, an opening of the guide member 87 is held in a state where the opening is directed toward the sheet S by a first holding portion including the retaining member 88 and the posture guide member 107 as shown in FIG. 7A.

Figure 7B:
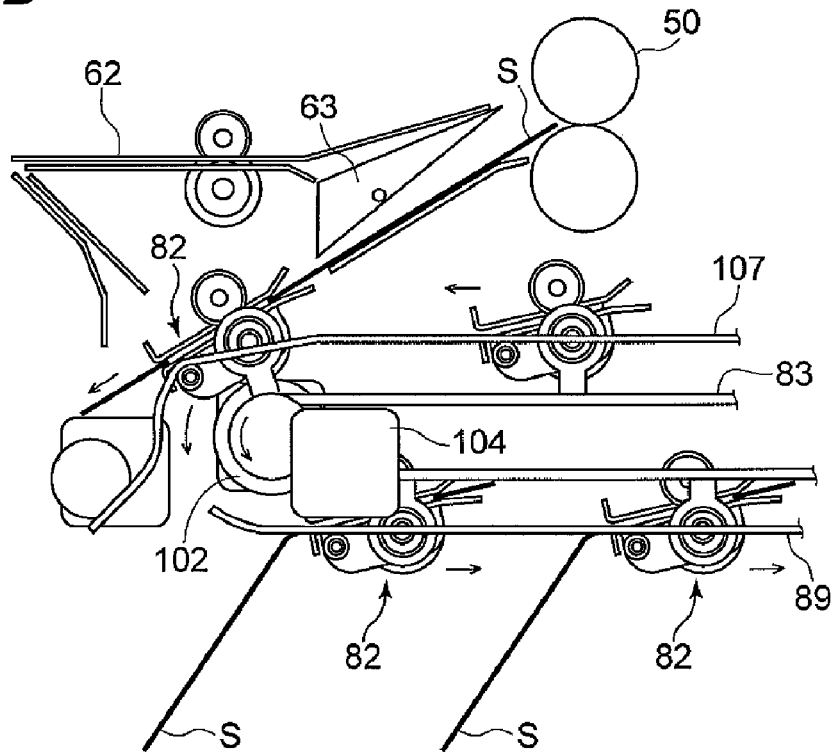

Next, when the roller gripper 82 comes to the receiving position, the roller drive motor 102 is driven and then, the gear 100 of the drive roller 84 and the drive gear 102*a* of the roller drive motor 102 mesh each other as shown in FIG. 4, and the drive roller 84 rotates. With this, after an image is formed on the first surface, the sheet S which passed through the carry-in port 63*a* is received into a guide of the roller gripper 82 as shown in FIG. 7B.

When the sheet S is delivered from the fixing device 50 to the roller gripper 82, a conveying speed of a sheet of the fixing device 50 which constitutes a sheet conveying portion and a sum of a moving speed of the roller gripper 82 and a rotation speed (roller sending speed) of the drive roller 84 of the roller gripper 82 become substantially equal to each other.

By setting the sheet conveying speed in this manner, the fixing operation of a sheet is not influenced. In this embodiment, a sheet is received while moving the roller gripper 82. A sheet may be received in a state where the roller gripper 82 is stopped instead. When the sheet is received in a state where the roller gripper 82 is stopped, the sending speed of the drive roller 84 should be the same as the sheet conveying speed of the fixing device 50.

When the sheet S passed through the fixing device 50, the speed of the roller drive motor 102 is increased, and the sheet S is pulled in by a predetermined distance. At that time, the roller gripper 82 moves as shown in FIG. 8A by the belt 83.

Figure 8A:
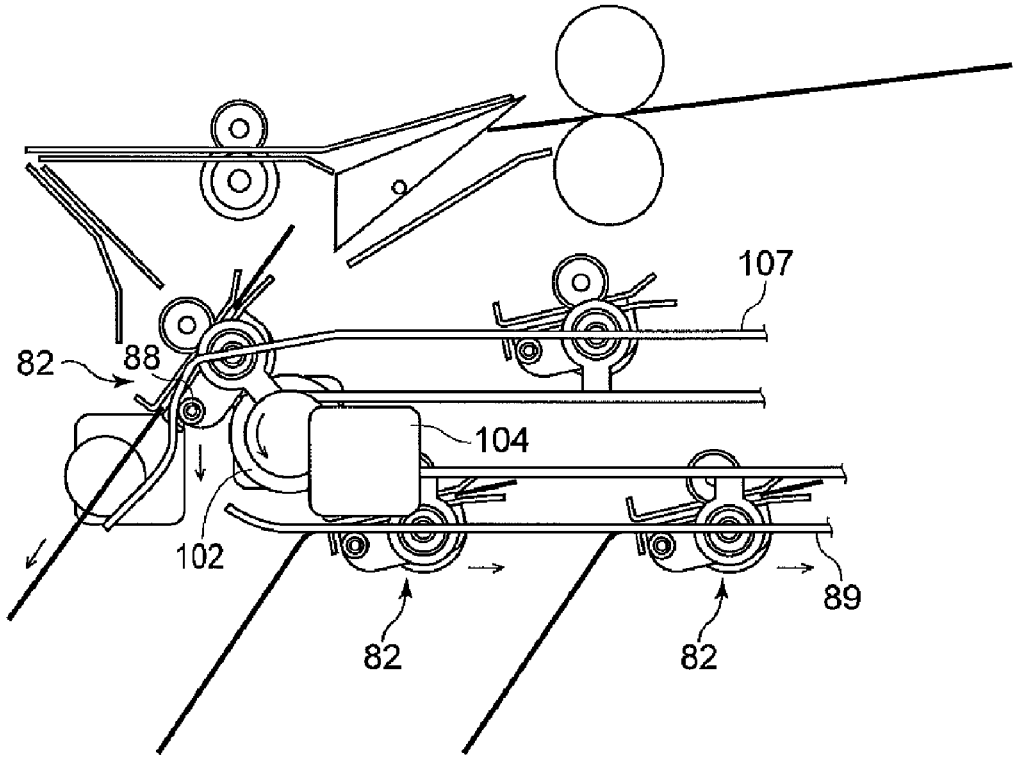
FIG. 8 are second diagrams for explaining the sheet turnover conveying operation of the reverse conveying apparatus.
Figure 8B:
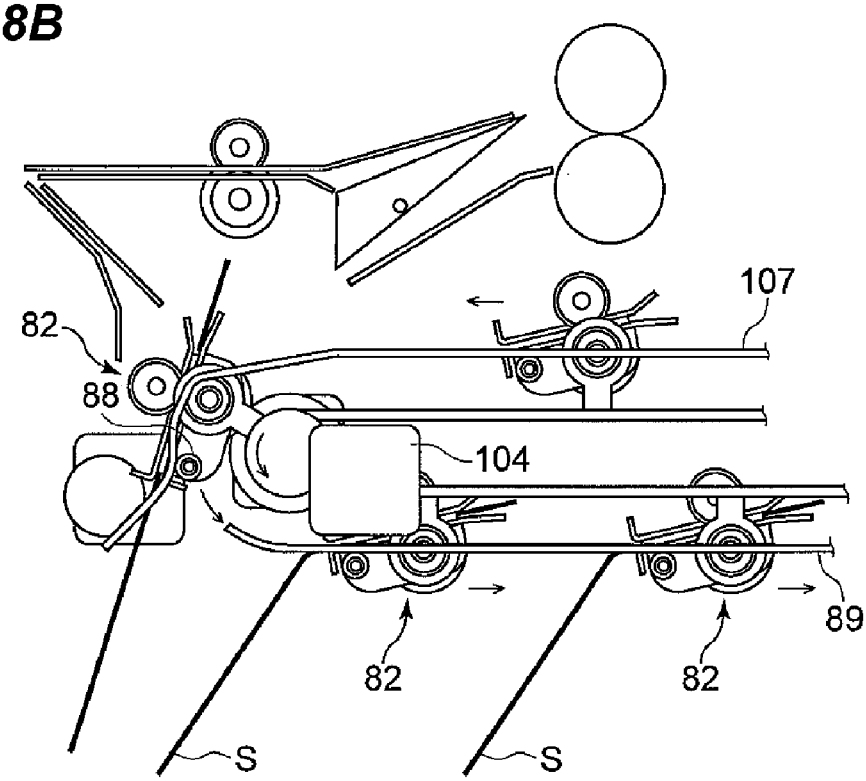

Then, the roller gripper 82 pulls in the sheet S shown in FIG. 8B to a position (turnover point) where the rotation of the roller gripper 82 can not be hindered. Then, the rotation of the roller drive motor 102 is stopped and the sheet S is supported by the pair of conveying rollers 84 and 85. At that time, the sheet S is supported by the pair of conveying rollers 84 and 85 in a state where the tip end of the sheet S comes to the lowest position.

Figure 9A:
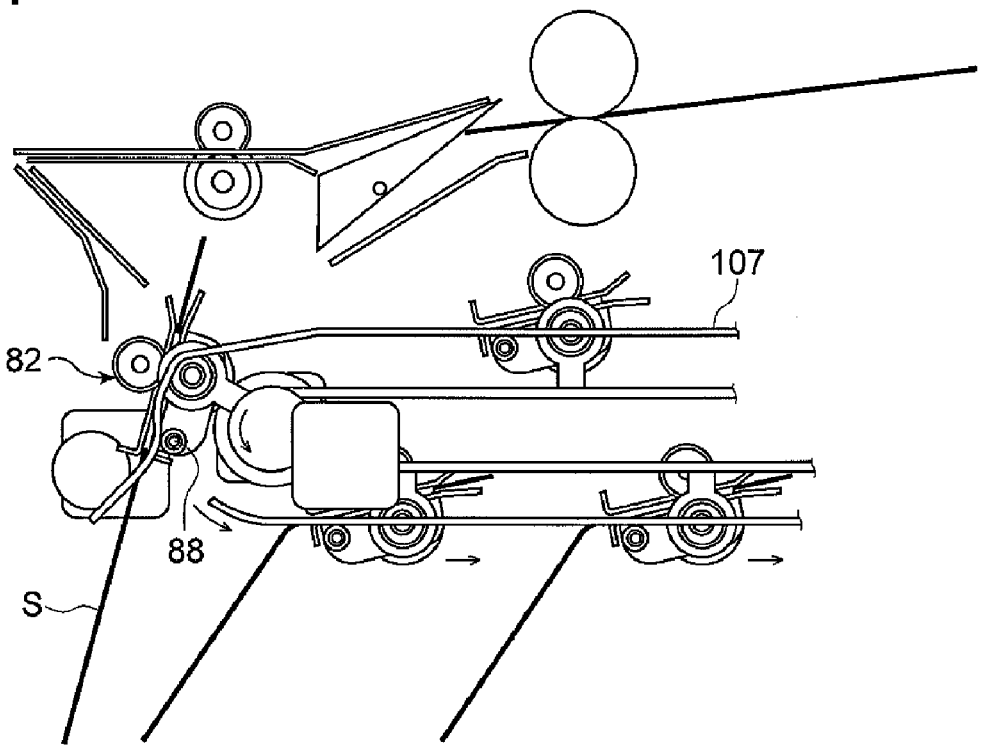
FIG. 9 are third diagrams for explaining the sheet turnover conveying operation of the reverse conveying apparatus.
Figure 9B:
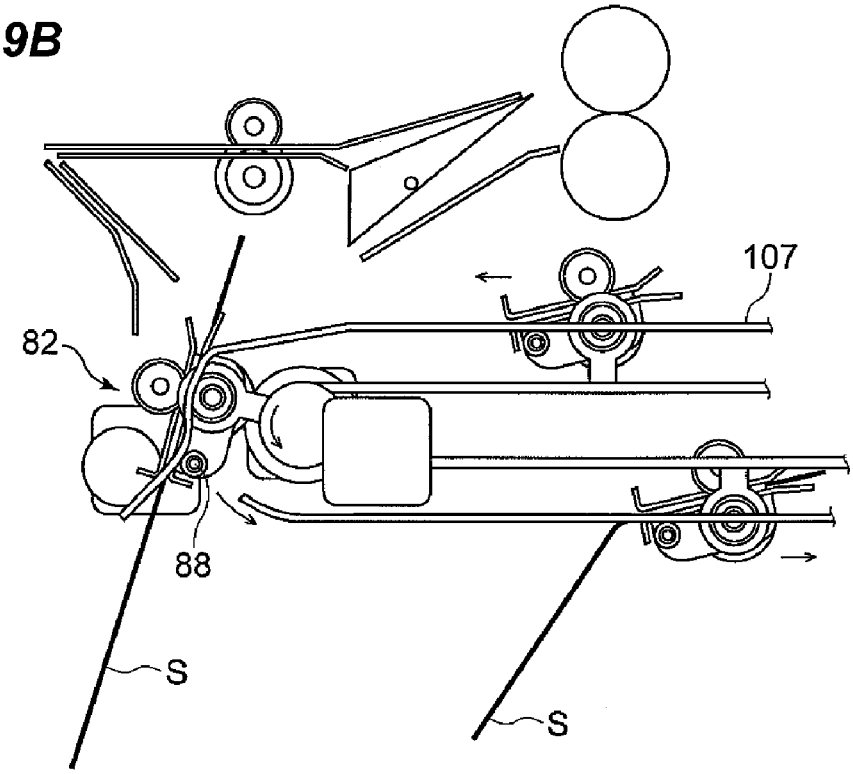
Figure 10A:
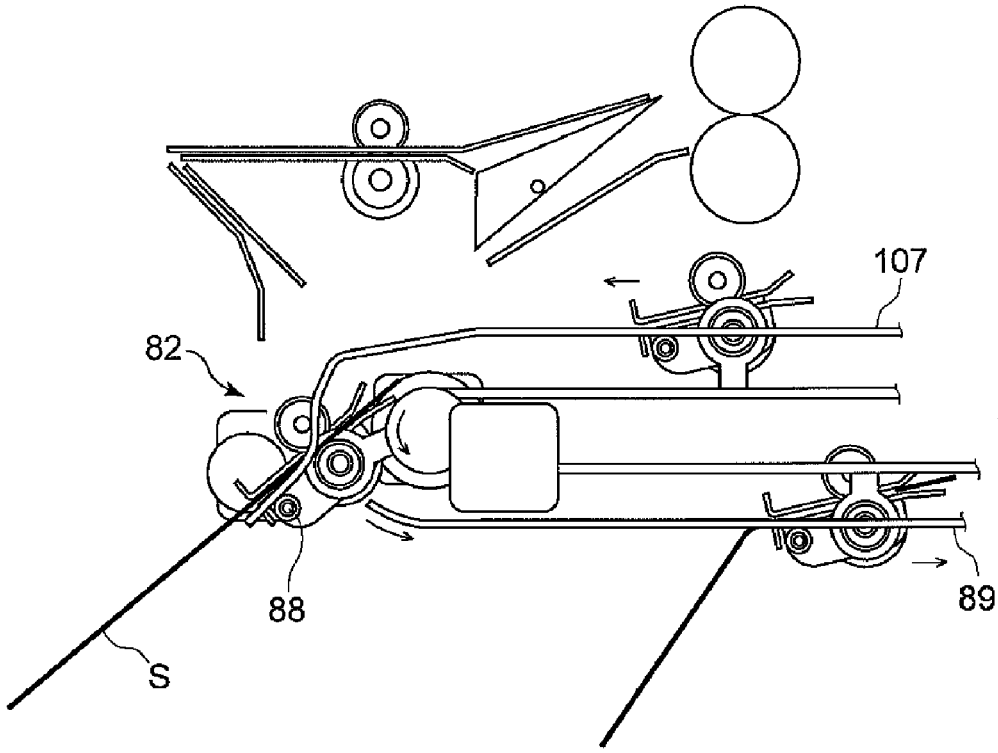
FIG. 10 are fourth diagrams for explaining the sheet turnover conveying operation of the reverse conveying apparatus.

Then, the roller gripper 82 which pulls in the sheet S moves in the direction of the vertically conveying path as the belt 83 rotates in a state where the roller gripper 82 supports the sheet S as shown in FIGS. 9A, B and FIG. 10A. At that time, the roller gripper 82 is directed upward by the retaining member 88 and the posture guide member 107. With this, when the sheet S is received, the sheet S is supported by the roller gripper 82 in a state where a rear end of the sheet S comes to the highest position.

Figure 10B:
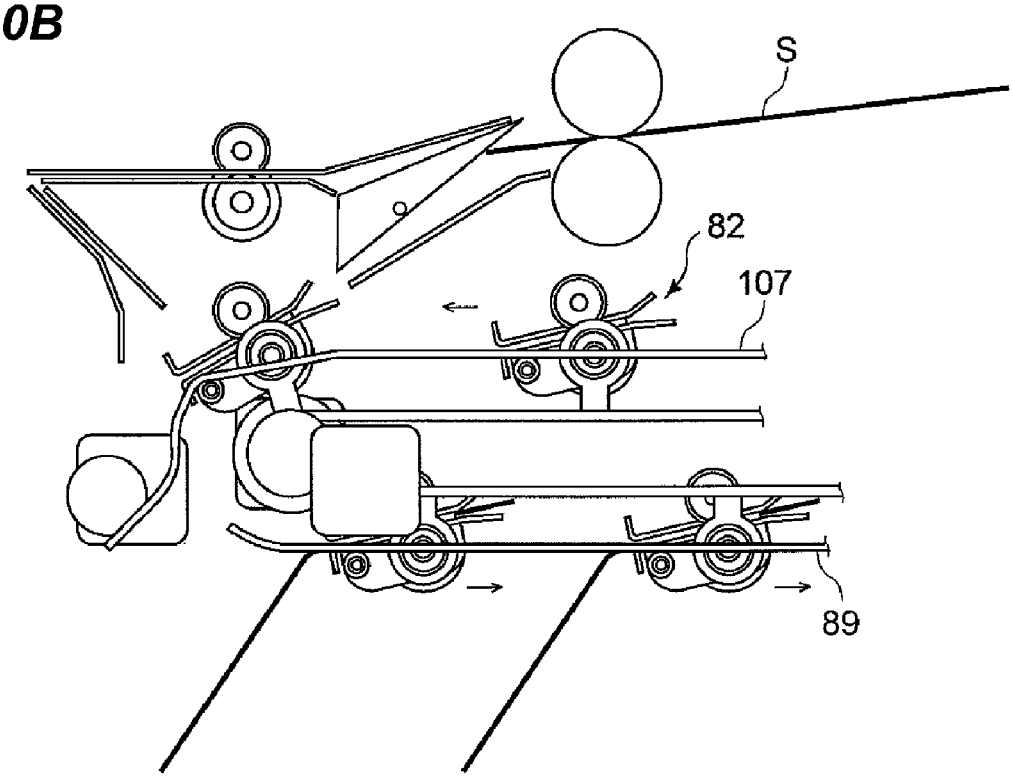

The roller gripper 82 moves as the belt 83 rotates, but the roller gripper 82 changes the retaining guide member from the upper posture guide member 107 to the lower posture guide member 89 as shown in FIG. 10B. That is, after the roller gripper 82 supports the sheet S, the roller gripper 82 is held in a state where a sheet can be conveyed out by a second holding portion comprising the retaining member 88 and the posture guide member 89.

As shown in FIG. 10B, if the roller gripper 82 which supports a sheet S passed through, a next roller gripper 82 moves toward the position shown in FIG. 7A for receiving a next sheet S which passed through the fixing device 50.

A distance between the conveyed sheets is varied depending upon the length of the sheet conveying direction. Thus, the moving speed can be changed in accordance with the length of a sheet, and the roller gripper 82 which supports a next sheet S is moved to the receiving position until next sheet comes.

In a long sheet, since it takes time to send the sheet to the roller gripper 82, the receiving operation into the roller gripper 82 is skipped once or twice so that the speed of the re-sending operation is increased and the productivity is enhanced. This operation is called a thinned-out operation.

Then, if the roller gripper 82 which nipped the sheet S and moved in the direction of the vertically conveying path 20*a* reaches the carry-out position, the gear 100 of the drive roller 84 and the drive gear 103*a* of the roller drive motor 103 meshes each other and the roller gripper 82 is driven.

With this, the sheet S is conveyed out in the direction of the vertically conveying path 20*a* in a state where a rear end of the sheet S when it is received becomes a leading end. The roller gripper 82 which received the sheet is moved to the carry-out position, the sheet is conveyed out in the state where the rear end of the sheet S when it is received becomes the leading end. With this, it is possible to turn over the sheet while moving the sheet at high speed without increasing the conveying distance of the sheet.

Figure 11A:
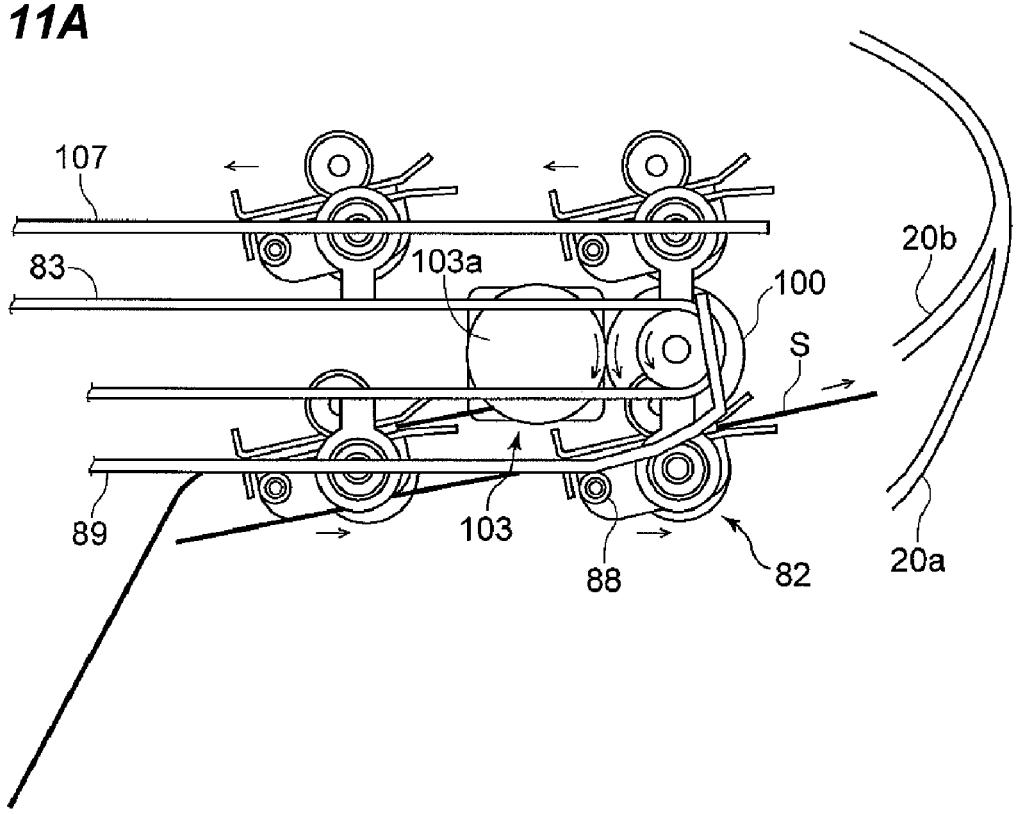
FIG. 11 are fifth diagrams for explaining the sheet turnover conveying operation of the reverse conveying apparatus.
Figure 11B:
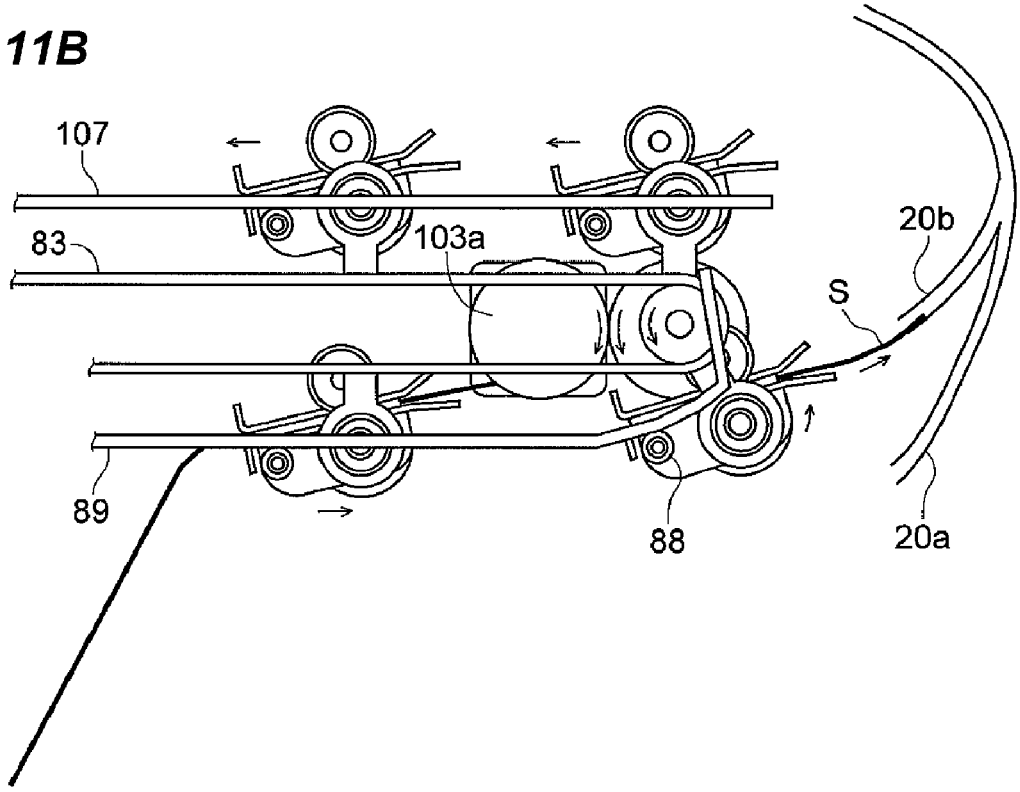

Thereafter, the state of the roller gripper 82 is brought into a state where a sheet S is directed in the direction of the vertically conveying path 20*a* as shown in FIG. 11B by the second holding portion including the posture guide member 89 and the retaining member 88.

Figure 12A:
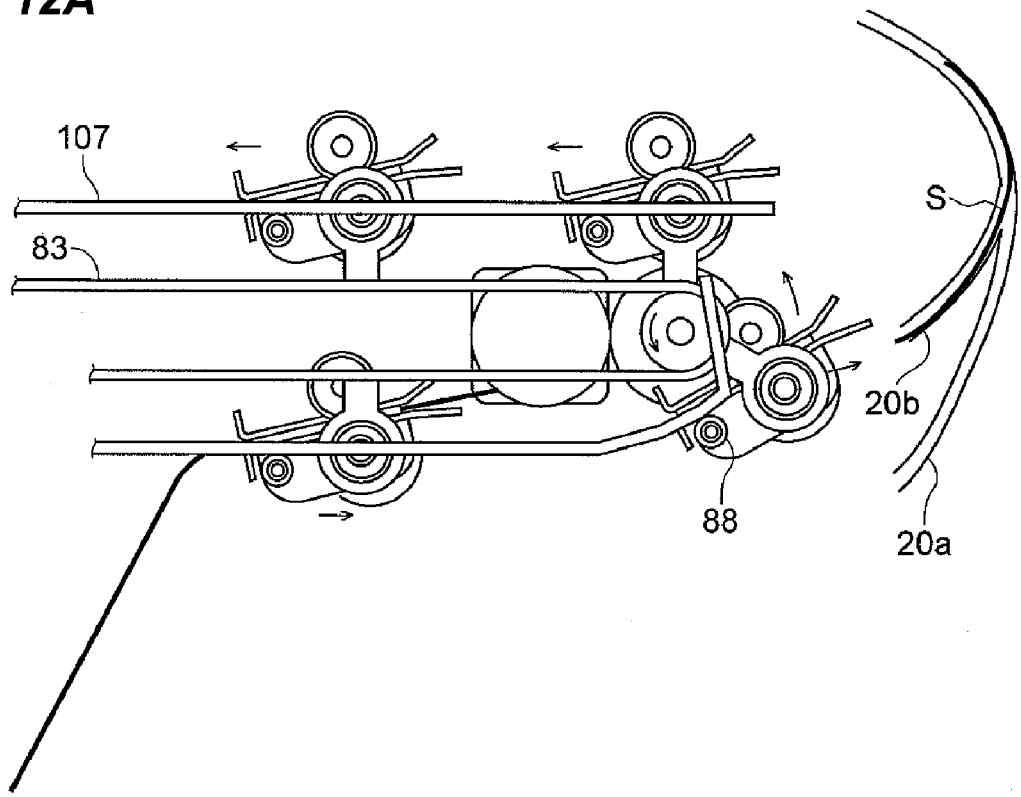
FIG. 12 are sixth diagrams for explaining the sheet turnover conveying operation of the reverse conveying apparatus.
Figure 12B:
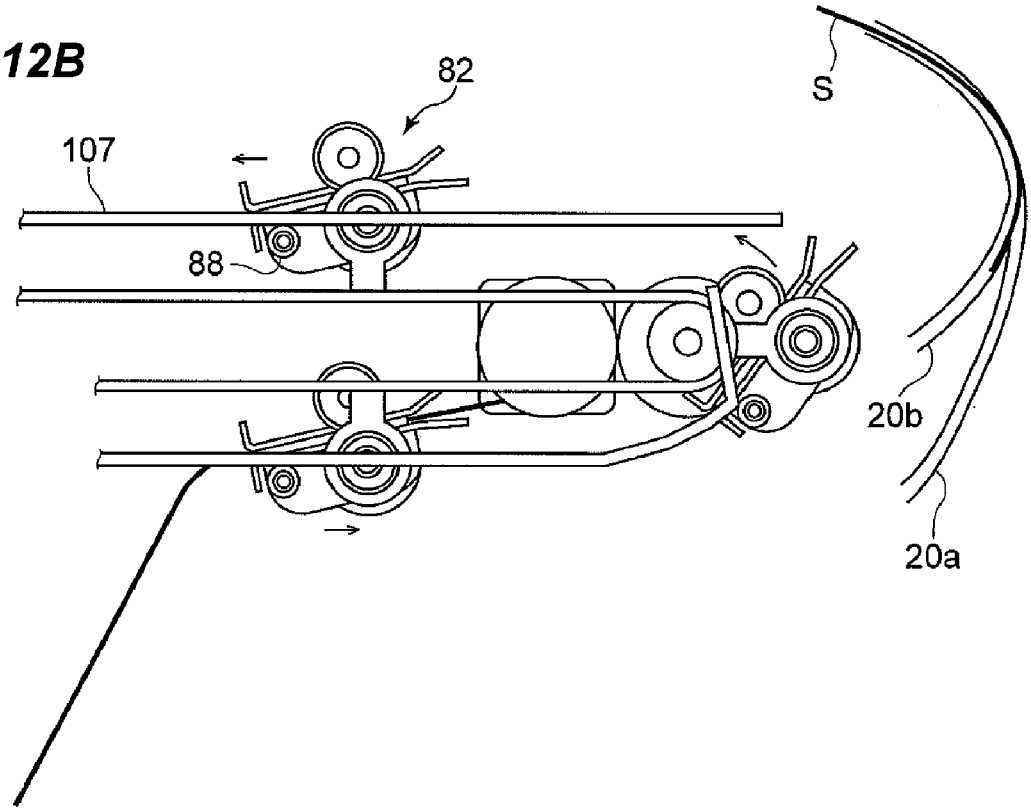
Figure 13:
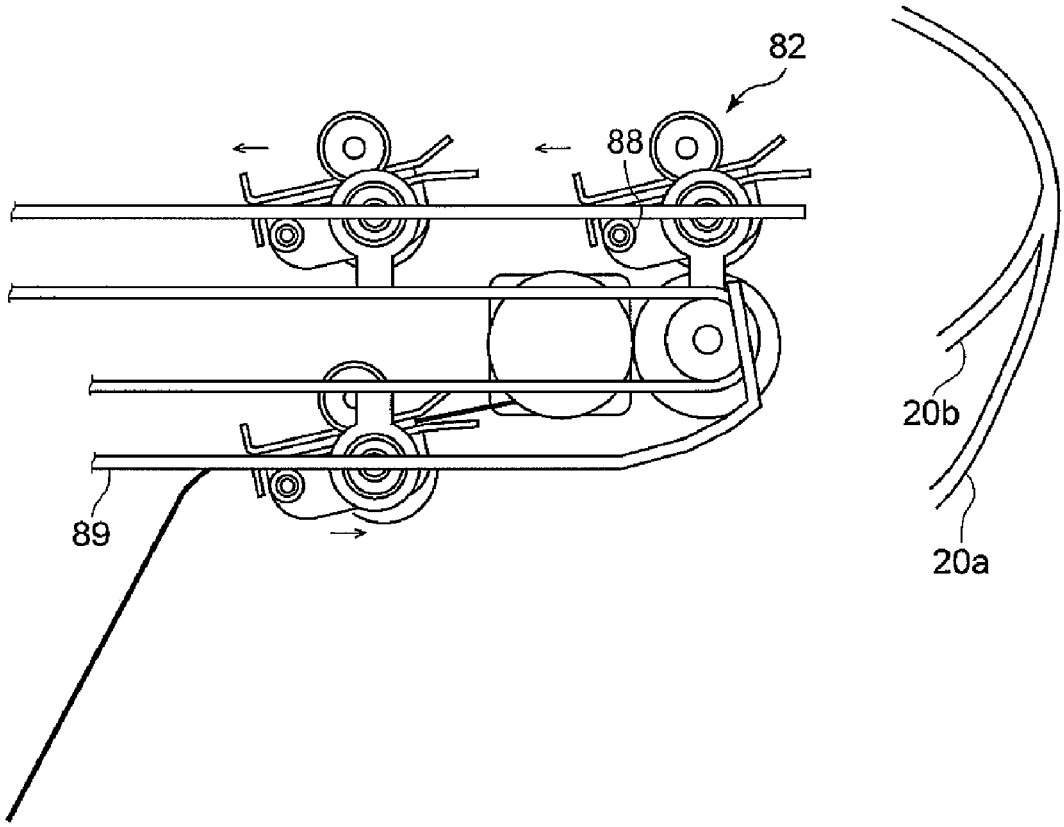
FIG. 13 is a seventh diagram for explaining the sheet turnover conveying operation of the reverse conveying apparatus.

Then, after the sheet S is conveyed out by the rotation of the drive roller 84 as shown in FIG. 12A, the driving of the roller drive motor 103 is stopped. After the sheet is conveyed out, the roller gripper 82 integrally moves with the belt 83 as shown in FIG. 12B, and the roller gripper 82 returns to the discharge portion such that the state of the roller gripper 82 is directed upward by the retaining member 88 and the posture guide member 107 as shown in FIG. 13.

The reverse conveying apparatus 81 of the embodiment can turn over a sheet from the carry-in port and discharge the sheet onto the discharge tray 61 shown in FIG. 1. Next, the sheet turnover discharging operation of the reverse conveying apparatus 81 will be explained.

Figure 14A:
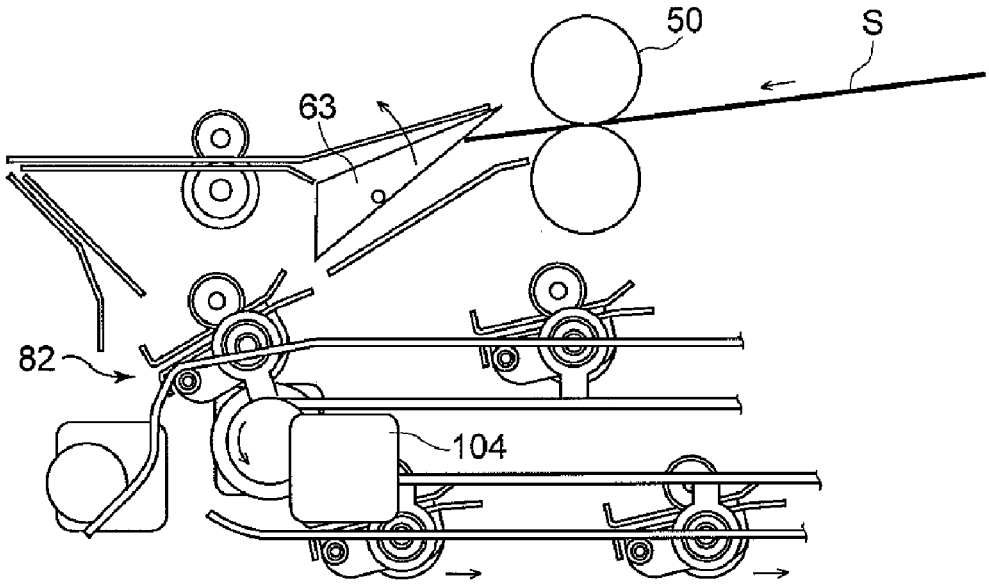
FIG. 14 are first diagrams for explaining a sheet turnover discharging operation of the reverse conveying apparatus.

When a sheet is turned over and discharged, the sheet S is introduced into the roller gripper 82 by switching the switching means 63 like the both-surface image forming operation. At that time, as shown in FIG. 14A, the roller gripper 82 is controlled by the retaining member 88 and the posture guide member 107 such that the opening of the guide member 87 is directed to the sheet S.

Figure 14B:
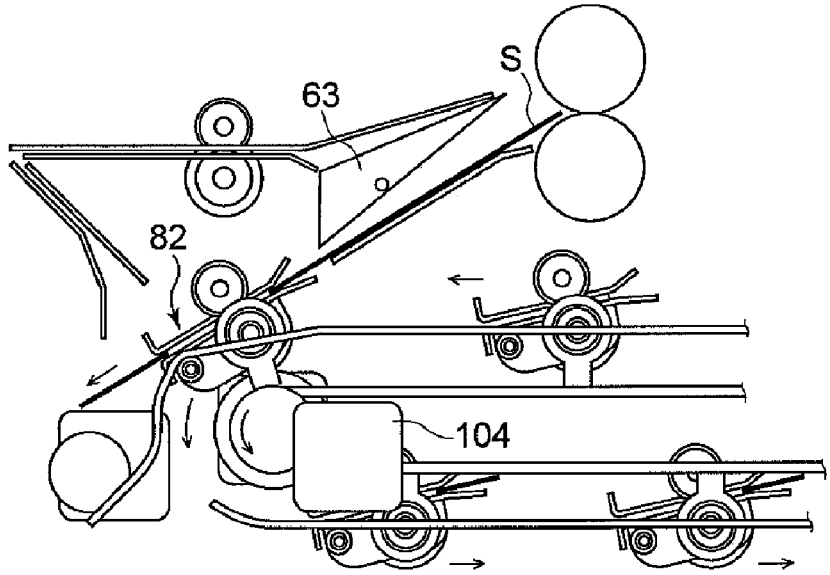

Next, when the roller gripper 82 comes to a predetermined position, the roller drive motor 102 is driven and then, the gear 100 of the drive roller 84 and the drive gear 102*a* of the roller drive motor 102 mesh each other as shown in FIG. 4, and the drive roller 84 rotates. With this the sheet S having the first surface formed an image is received by the roller gripper 82 as shown in FIG. 14B.

When a sheet S is delivered from the fixing device 50 to the roller gripper 82, a conveying speed of the sheet of the fixing device 50 and a sum of a moving speed of the roller gripper 82 and a rotation speed (roller sending speed) of the drive roller 84 of the roller gripper 82 become substantially equal to each other. The rotation speed of the drive roller 84 in a structure in which movement of the roller gripper 82 is stopped when a sheet is delivered is the same as the sheet conveying speed of the fixing device 50.

Further, the speed of the roller drive motor 102 is increased when a sheet S passes through the fixing device 50, and the sheet S is pulled by a predetermined distance. At that time, the roller gripper 82 is moved by the belt 83 as shown in FIG.

Figure 15A:
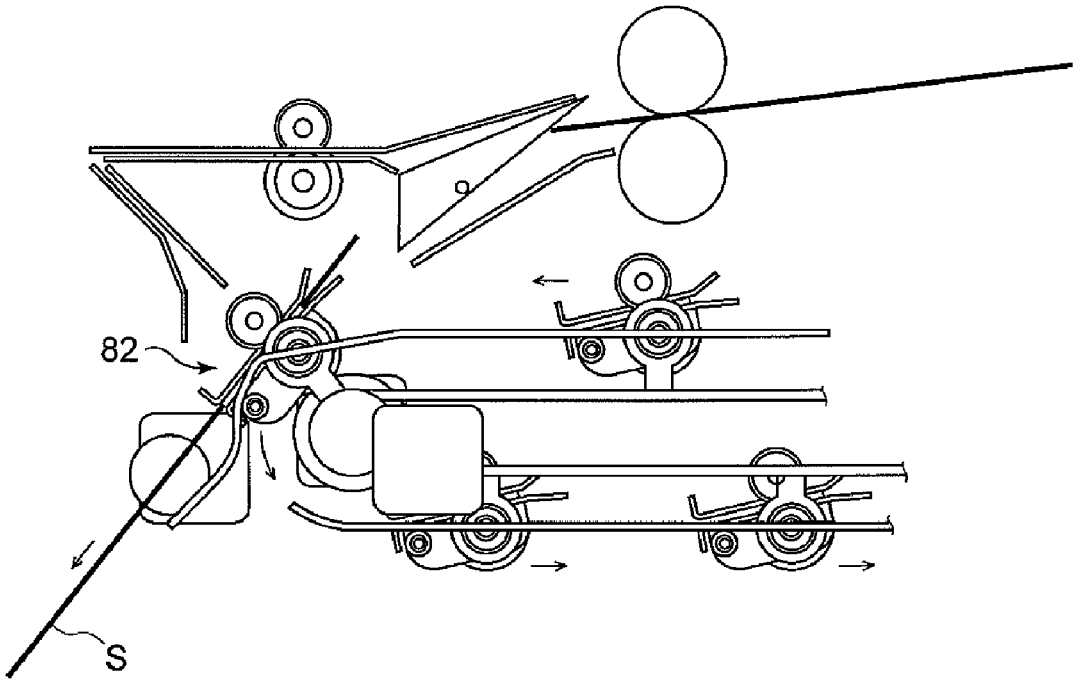
FIG. 15 are second diagrams for explaining the sheet turnover discharging operation of the reverse conveying apparatus.
Figure 15B:
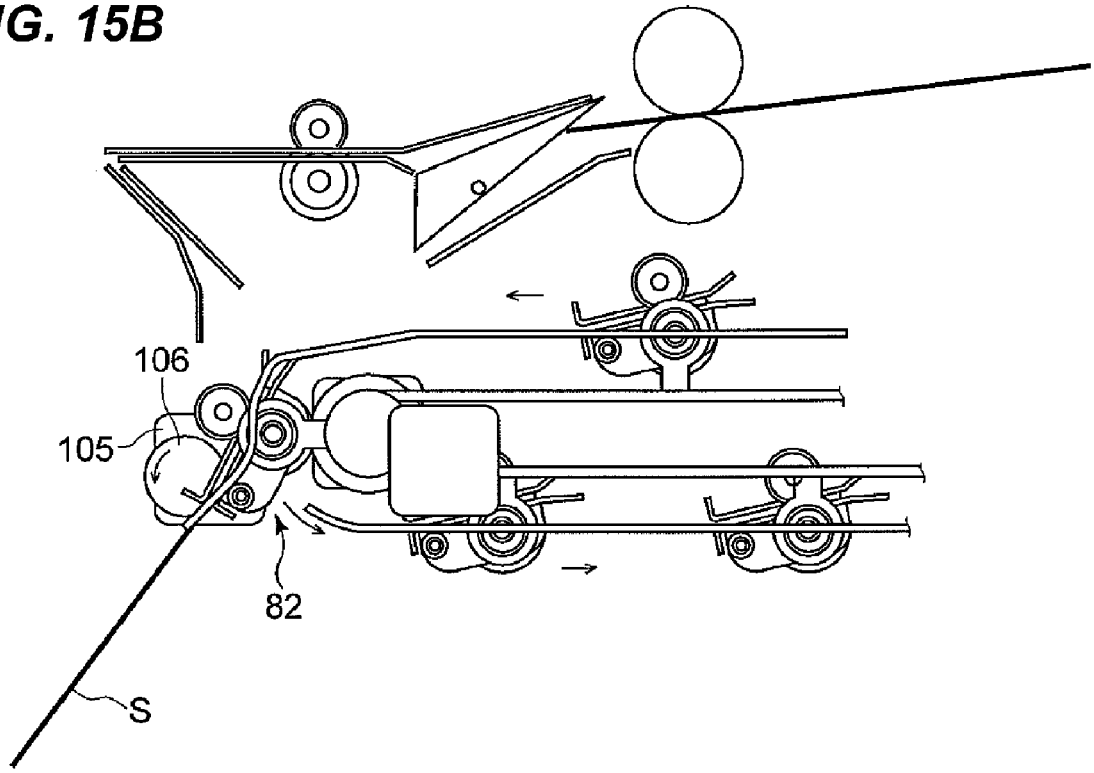

15A. Thereafter, the roller gripper 82 pulls in a sheet to a predetermined position (turnover point) where the sheet S does not hinder the rotation of the roller gripper 82, the rotation of the roller drive motor 102 is stopped. With this, the drive roller 84 and the follower roller 85 support the sheet S as shown in FIG. 15B.

Figure 16:
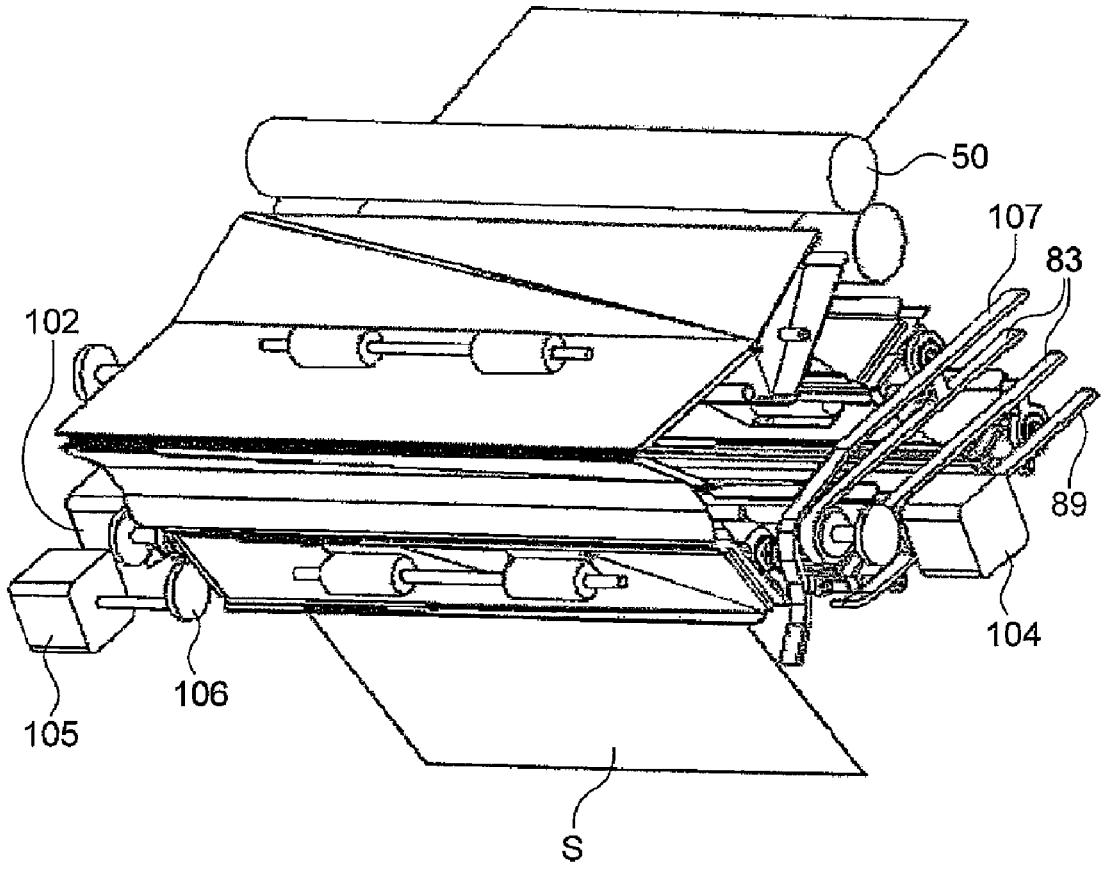
FIG. 16 is a second diagram for explaining a structure of the reverse conveying apparatus of the color image forming apparatus.

As shown in FIG. 16, this embodiment has a turnover cam motor 105 which rotates a cam 106 which is a switching portion for directing the roller gripper 82 supporting a sheet S toward the turnover discharge passage 62*a*. In the case of the sheet turnover discharging operation, a carry-out position of the roller gripper 82 which conveys out a sheet such that a rear end of the sheet when it is received becomes a leading end is a direction in which the sheet is directed toward the turnover discharge passage 62*a*.

Figure 17:
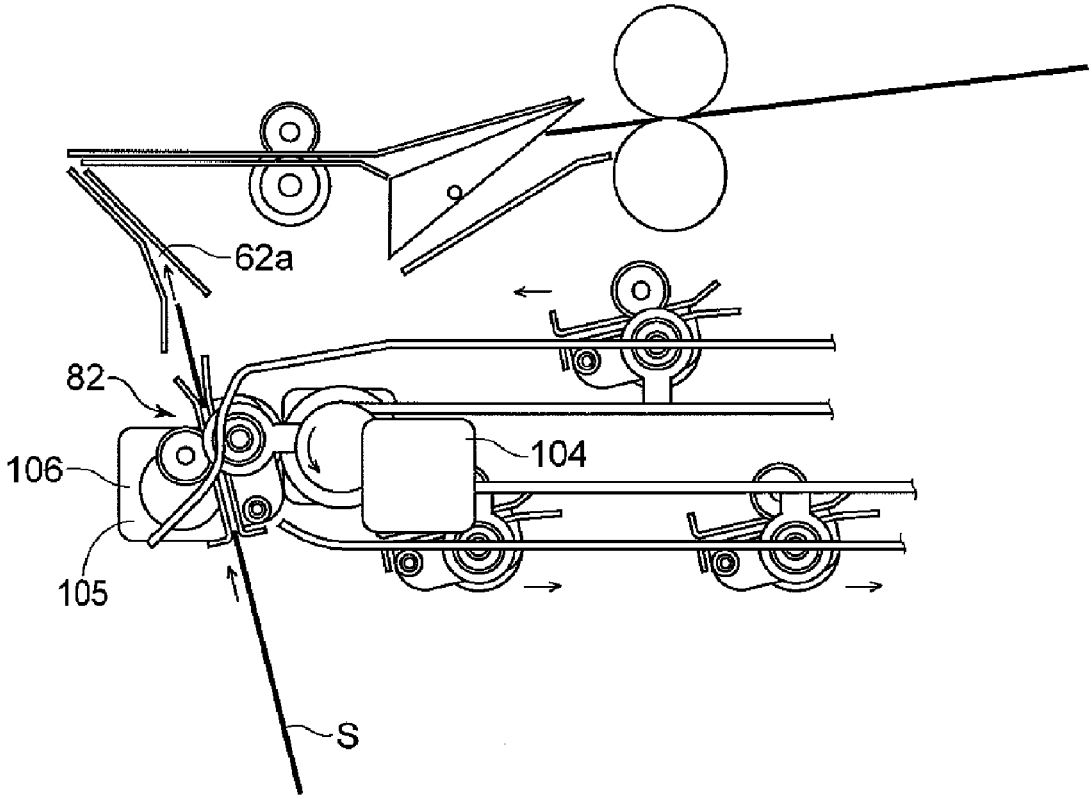
FIG. 17 is a third diagram for explaining the sheet turnover discharging operation of the reverse conveying apparatus.

After the sheet is supported in this manner, the turnover cam motor 105 is rotated, and the roller gripper 82 is directed to the turnover discharge passage 62*a* by the cam 106 as shown in FIG. 17.

Thereafter, the roller drive motor 102 is reversely rotated to send out the sheet S in the direction of the turnover discharge passage 62*a*. After the sheet S is sent out in this manner, the turnover cam motor 105 is rotated to return the cam 106 to its original position. The roller gripper 82 which sent out the sheet S moves toward the vertically conveying path, and a next sheet S is sent from the fixing device 50 to a next roller gripper 82. As described above, in this embodiment, the roller gripper 82 which receives a sheet is moved to the carry-out position, and the sheet is conveyed such that a rear end when the sheet S is received is a leading end. With this, each sheet is turned over at the roller gripper 82, the turnover time can be shortened, sliding caused at the time of switch back is eliminated, and a jam can be reduced.

Since a sheet can be turned over while moving the same at high speed without increasing the conveying distance of the sheet, the conveyance speed of a sheet can be increased.

The reverse conveying apparatus 81 is not provided with a guide. Therefore, it is possible to prevent an image failure (roller trace, slide of image) caused by heat accumulated by a guide when sheets are fed continuously, and adhesion of toner. Next, a second embodiment of the present invention will be described.

Figure 18:
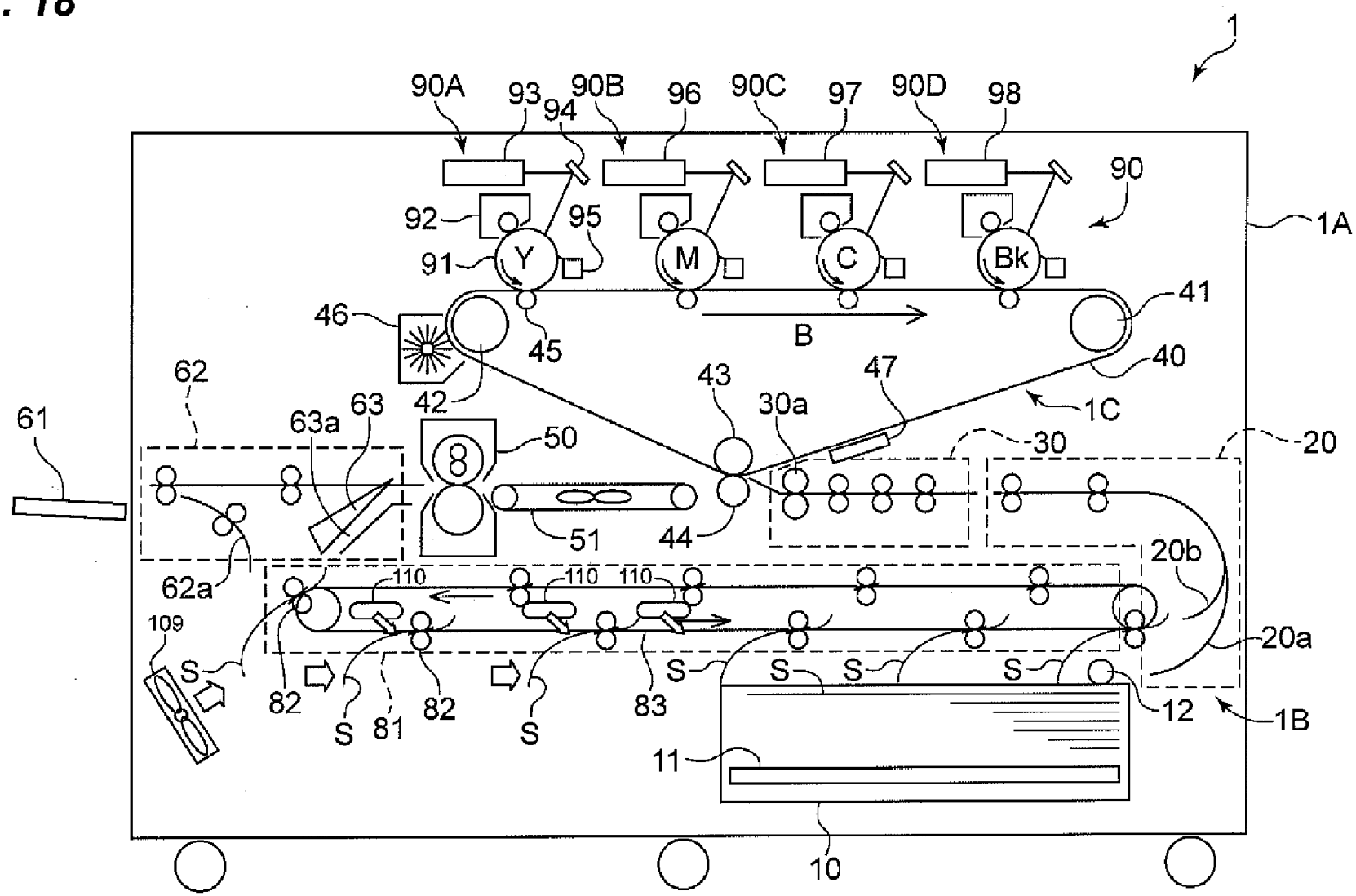
FIG. 18 is a diagram illustrating an outline structure of a color image forming apparatus which is one example of an image forming apparatus according a second embodiment of the invention.
Figure 19:
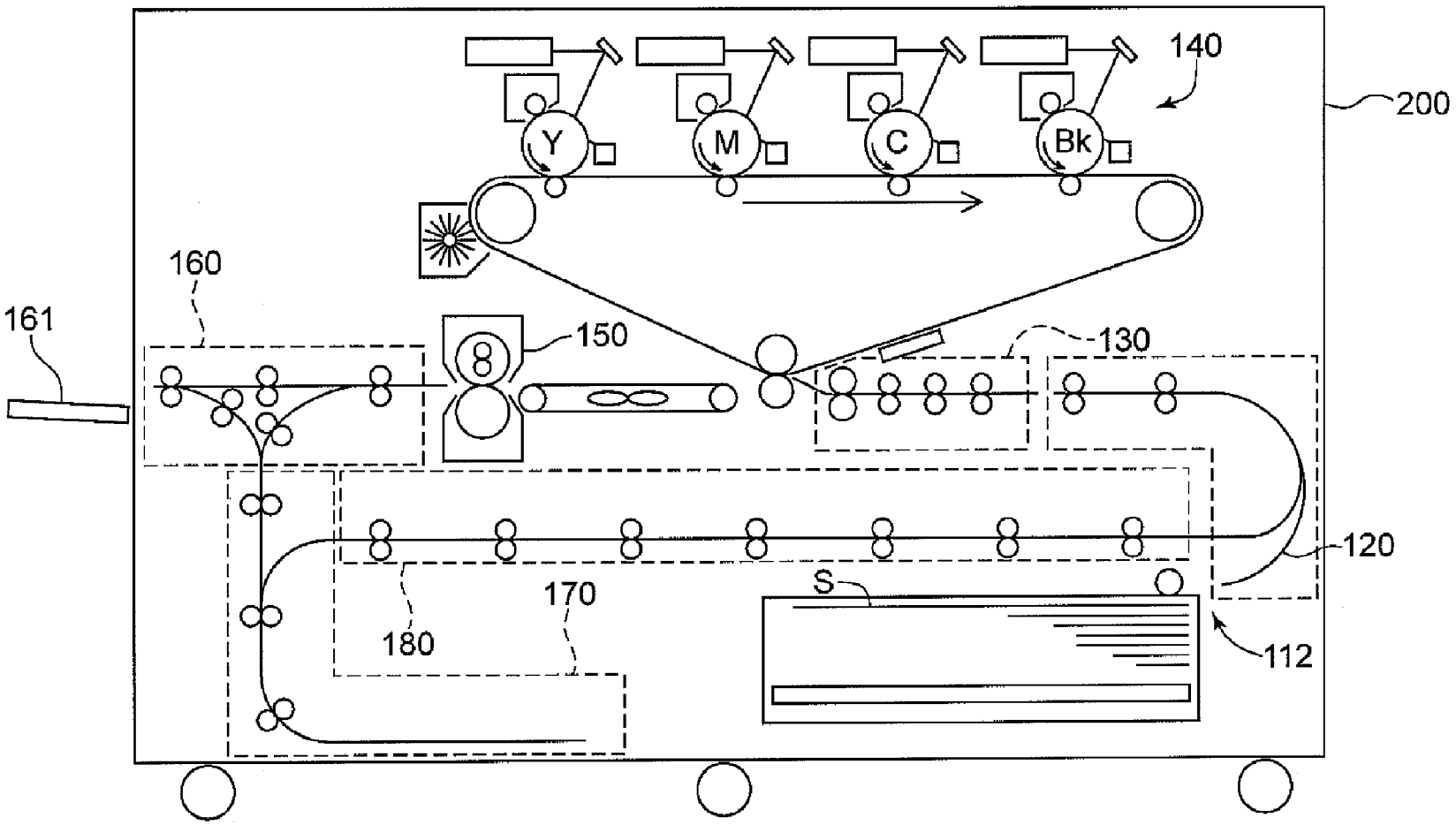
FIG. 19 PRIOR ART
FIG. 19 is a diagram illustrating an outline structure of a conventional image forming apparatus.

FIG. 18 is a diagram showing an outline structure of a color image forming apparatus which is one example of an image forming apparatus according the second embodiment. In FIG. 18, the same symbols as those in FIG. 1 designate the same members.

In FIG. 18, a cooling fan 109 constitutes a cooling portion which cools a sheet S supported by the roller gripper 82 by spraying air toward the reverse conveying apparatus 81. Cooling fans 110 constitute a cooling portion which cools a sheet S supported by the roller gripper 82 by spraying air downward from between the belt 83 on both surfaces.

In this second embodiment and the first embodiment, since the conveying path of the reverse conveying apparatus 81 is not surrounded by a guide plate, it is possible to efficiently cool an image surface which is heated by toner image by the cooling fans 109 and 110.

As in this embodiment, a sheet S supported by the roller gripper 82 is cooled by the cooling fans 109 and 110 without surrounding the conveying path by the guide plate, and a sheet S can be fed to the image forming portion 90 at a constant temperature. As a result, in the both-surface image forming operation, it is possible to prevent the temperature of the image forming portion 90 from being increased by a sheet S, and an excellent image can be formed.

In this embodiment, positions of the cooling fans 109 and 110 are positions where air is sprayed in the moving direction of the roller gripper 82 in a state where a sheet S is supported. However, when there is a fear that the sheet S is caught on the sheet storage case 10, the positions of the cooling fans 109 and 110 may be positions where air is sprayed in a direction opposite from the moving direction of the roller gripper 82 with respect to the sheet S.

In the above description, the endless belt 83 is employed as the moving member, and the roller gripper may be moved by a wire. The roller gripper may include an automatic running means (motor) as the moving member, and the roller gripper may move along the endless rail by the automatic running means While the present invention has been described with reference to exemplary embodiments, it is to be understood that the invention is not limited to the disclosed exemplary embodiments. The scope of the following claims is to be accorded the broadest interpretation so as to encompass all such modifications and equivalent structure and functions.

This application claims the benefit of Japanese Patent Application No. 2007-228150, filed Sep. 3, 2007, which is hereby incorporated by reference herein in its entirety.

What is claimed is:

1. An image forming apparatus comprising:

an image forming portion which forms an image on a sheet; and a re-conveying portion which again conveys a sheet formed with an image by the image forming portion to the image forming portion, wherein the re-conveying portion includes:

a plurality of sheet support portions which support a sheet formed with an image by the image forming portion; and a moving member which moves the plurality of sheet support portions to a receiving position where a sheet is received and a carry-out position where a supported sheet is conveyed out, wherein the sheet support portions include:

a pair of normally and reversely rotatable rollers which receive a sheet by normal rotation and convey out a sheet by reverse rotation;

a guide member which guides the reception of a sheet to the pair of rollers and the conveyance of a sheet by the pair of rollers;

a first holding portion which holds the sheet support portion in a state where a sheet is receivable when the sheet support portion moves to the receiving position;

a second holding portion which holds the sheet support portion in a state where a sheet is conveyable out when the sheet support portion moves to the carry-out position;

a first drive portion which drives the pair of rollers such the sheet support portion, which is held by the first holding portion in a state where a sheet is receivable, receives a sheet; and a second drive portion which drives the pair of rollers such that a sheet is conveyed out from the sheet support portion, which is held in a state where a sheet is conveyable out by the second holding portion, wherein when a sheet is conveyed out at the carry-out position, the sheet is conveyed out such that a rear end of the sheet at the receiving position is a leading end at the carry-out position.

2. The image forming apparatus according to claim 1, further comprising:

a sheet conveying portion which conveys a sheet formed with an image to the re-conveying portion, wherein a sum of a rotation speed of the pair of rollers and a moving speed of the moving member when a sheet formed with an image is received is substantially equal to a sheet conveying speed of the sheet conveying portion.

3. The image forming apparatus according to claim 2, wherein the rotation speed of the pair of rollers after a sheet is received from the sheet conveying portion is faster than a rotation speed of the pair of rollers when a sheet is received from the sheet conveying portion.

4. The image forming apparatus according to claim 1, further comprising:

a locking portion which locks rotation of the pair of rollers; and an unlocking portion which unlocks the locking portion when the pair of rollers are driven.

5. The image forming apparatus according to claim 1, wherein the guide member is substantially horizontal when the pair of rollers are not driven.

6. The image forming apparatus according to claim 1, further comprising a switching portion which switches the sheet support portion which receives a sheet to a state where the sheet is discharged such that a rear end when received is a leading end.

7. The image forming apparatus according to claim 1, wherein a moving speed of the moving member is variable in accordance with a length of a sheet in a sheet conveying direction.

8. The image forming apparatus according to claim 1, further comprising a cooling portion which cools a sheet supported by the sheet support portion.

* * * * *